US005658231A

United States Patent [19]

Schmitt et al.

[11] Patent Number: 5,658,231

[45] Date of Patent: Aug. 19, 1997

[54] MECHANISM FOR SECURING A SEPARATION BOWL TO A MECHANICAL CHUCK

[75] Inventors: Carl Schmitt, Denens, Switzerland; Jacques Chammas, Dedham; Joseph Michael Medberry, Seekonk, both of Mass.

[73] Assignee: Haemonetics Corporation, Braintree, Mass.

[21] Appl. No.: 531,409

[22] Filed: Sep. 21, 1995

[51] Int. Cl.[6] ..... B04B 15/00

[52] U.S. Cl. ..... 494/12; 494/84; 279/131

[58] Field of Search ..... 494/41, 43, 12, 494/84, 85; 279/35, 106, 129, 130, 131; 269/21

[56] References Cited

U.S. PATENT DOCUMENTS

| | | | |
|---|---|---|---|
| 636,383 | 11/1899 | Hartmann . | |
| 2,207,621 | 7/1940 | Hite | 279/131 X |
| 2,345,786 | 4/1944 | Berg | 279/131 X |
| 2,443,895 | 6/1948 | Day et al. | 279/106 X |
| 2,572,374 | 10/1951 | Oas et al. | 279/131 X |
| 2,839,307 | 6/1958 | Garrison et al. | 279/131 |
| 3,073,517 | 1/1963 | Pickels et al. . | |
| 3,145,713 | 8/1964 | Latham, Jr. . | |
| 3,317,127 | 5/1967 | Cole . | |
| 3,581,981 | 6/1971 | Latham, Jr. . | |
| 3,706,412 | 12/1972 | Latham, Jr. . | |
| 3,785,549 | 1/1974 | Latham, Jr. . | |
| 4,684,361 | 8/1987 | Feldman et al. | 494/41 |
| 4,692,136 | 9/1987 | Feldman et al. | 494/38 |
| 4,718,888 | 1/1988 | Darnell | 494/85 |
| 4,767,396 | 8/1988 | Powers . | |
| 4,795,419 | 1/1989 | Yawn | 494/84 |
| 4,838,849 | 6/1989 | Calari . | |
| 4,889,524 | 12/1989 | Fell et al. . | |
| 5,062,826 | 11/1991 | Mantovani et al. | 494/85 |
| 5,308,309 | 5/1994 | Morris . | |

FOREIGN PATENT DOCUMENTS

| | | | |
|---|---|---|---|
| 225647 | 8/1985 | German Dem. Rep. | 279/131 |
| 60-79724 | 5/1985 | Japan | 279/131 |
| 665951 | 6/1979 | U.S.S.R. | 279/131 |
| 688295 | 9/1979 | U.S.S.R. | 279/131 |
| 1053978 | 11/1983 | U.S.S.R. | 279/131 |

*Primary Examiner*—Charles E. Cooley
*Attorney, Agent, or Firm*—Cesari and McKenna

[57] ABSTRACT

A centrifugal chuck comprising a chuck housing and a plurality of fingers pivotally mounted around the outer perimeter of the chuck housing. Each finger includes a tip, adapted to receive the base portion of a separation bowl. The fingers are mounted to the chuck housing so that the tips can pivot in a generally radial direction. Rotation of the chuck urges each gripping finger against the bowl.

11 Claims, 9 Drawing Sheets

MECHANISM FOR SECURING A SEPARATION BOWL TO A MECHANICAL CHUCK

FIELD OF THE INVENTION

The present invention relates to centrifuges for separating blood and similar fluids. More specifically, the present invention relates to improvements in the centrifuge chuck which transmits the rotational speed of the centrifuge motor to the separation bowl.

BACKGROUND OF THE INVENTION

Conventional blood processing devices employ large centrifugal forces to separate the different components of whole blood. Whole blood comprises plasma, red blood cells, white blood cells and platelets, each having a different density. By subjecting whole blood to large centrifugal forces, its individual components can be separated into distinct density phases, and the individual components drawn-off and collected.

In order to generate the large centrifugal forces needed for separation, blood processing devices rotate at very high speeds. The devices typically include a bowl into which whole blood is introduced for separation. The bowl is generally connected at its base to a chuck which in turn is operably connected to a centrifuge motor that rotates the chuck and, hence, the bowl at very high speeds.

Various designs of blood separating bowls exist, including, for example, the Latham bowl and the blow-molded bowl. It is desirable for the bowl to be easily removed from the chuck to facilitate convenient replacement of the bowl. While the bowl is spinning, however, it is extremely important that the bowl be securely attached to the chuck due to the large centrifugal forces at work. Conventional chuck designs, such as the vacuum chuck, include of a number of components which are subject to wear and tear and eventually failure over time. In addition, these designs do not always ensure that the bowl is securely attached to the chuck at all times. Due to the high rotational speeds involved in the separation process, failure to properly secure the bowl to the centrifuge may result in damage to the bowl or a loss of blood product. Therefore, a need has developed for a mechanism by which the bowl can be easily inserted into and removed from the chuck, while at the same time being firmly secured thereto during operation. It is also desirable that the insertion and removal of the bowl involve as few steps as possible, so that the possibility of improperly attaching the bowl to the centrifuge will be minimized.

SUMMARY OF THE INVENTION

The improved centrifugal chuck of the present invention comprises at least three fingers for gripping the outer circumference of the base of the separation bowl. The fingers are pivotally mounted around the outer circumference of the chuck housing and extend in a generally axial direction, parallel to the axis of rotation of the centrifuge. The fingers are pivotally attached to the outer perimeter of the chuck housing such that the tips of the fingers can move in a generally radial direction either toward or away from the centrifuge's axis of rotation. The centrifugal motor, which rotates the chuck and the separation bowl, is attached to the center of the chuck housing on the opposite side from the bowl.

To insert the bowl into the chuck, the tips of the fingers are displaced outwardly and the bowl is snapped into place. The tips of the fingers are sloped in such a manner that, by pushing the bowl toward the chuck housing, the fingers are displaced outwardly, allowing easy installation of the bowl.

In addition, a spring may be associated with each finger. The spring is disposed between the finger and the chuck housing in order to urge the tip of the finger inwardly, i.e. toward the centrifuge's axis of rotation. As a result, when the bowl is fully seated in the chuck housing, the springs cause the fingers to hold the bowl in place. The tip of each finger is also adapted to receive the bottom portion of the bowl, thereby providing a more secure fit.

The fingers are mounted to the chuck housing such that the center of mass of each finger is below the pivot point of the finger. In other words, the center of mass is located between the pivot point and the base of the finger. As a result, when the centrifuge begins to spin, the centrifugal force, acting through the center of mass of the finger, urges the finger to rotate about its pivot point such the tip of the finger pivots inwardly toward the centrifuge's axis of rotation and the lower section pivots outwardly. The tips of the fingers, however, are in contact with the base of the separation bowl. Thus, the pivoting action of the fingers, caused by the fingers being pivotally mounted off-set from their centers of mass, imposes a holding or gripping force on the rotating bowl. In addition, the higher the rotational speed of the centrifuge, the higher will be the holding force exerted by the fingers on the bowl. In this manner, the bowl is securely retained in the centrifuge during all rotational speeds, including the high rotational speeds needed to separate whole blood and other similar fluids.

In addition, when the centrifuge is stopped and the bowl is no longer spinning, there is no centrifugal force urging the tips of the fingers inward. Although the springs tend to pivot the tips of the fingers inward, even when the centrifuge is stopped, the spring force is kept relatively low. Accordingly, the centrifuge operator can quickly and easily unsnap the bowl from the chuck, by simply pulling the bowl away from the chuck with one hand.

DESCRIPTION OF THE PREFERRED EMBODIMENT

Figure 1A:
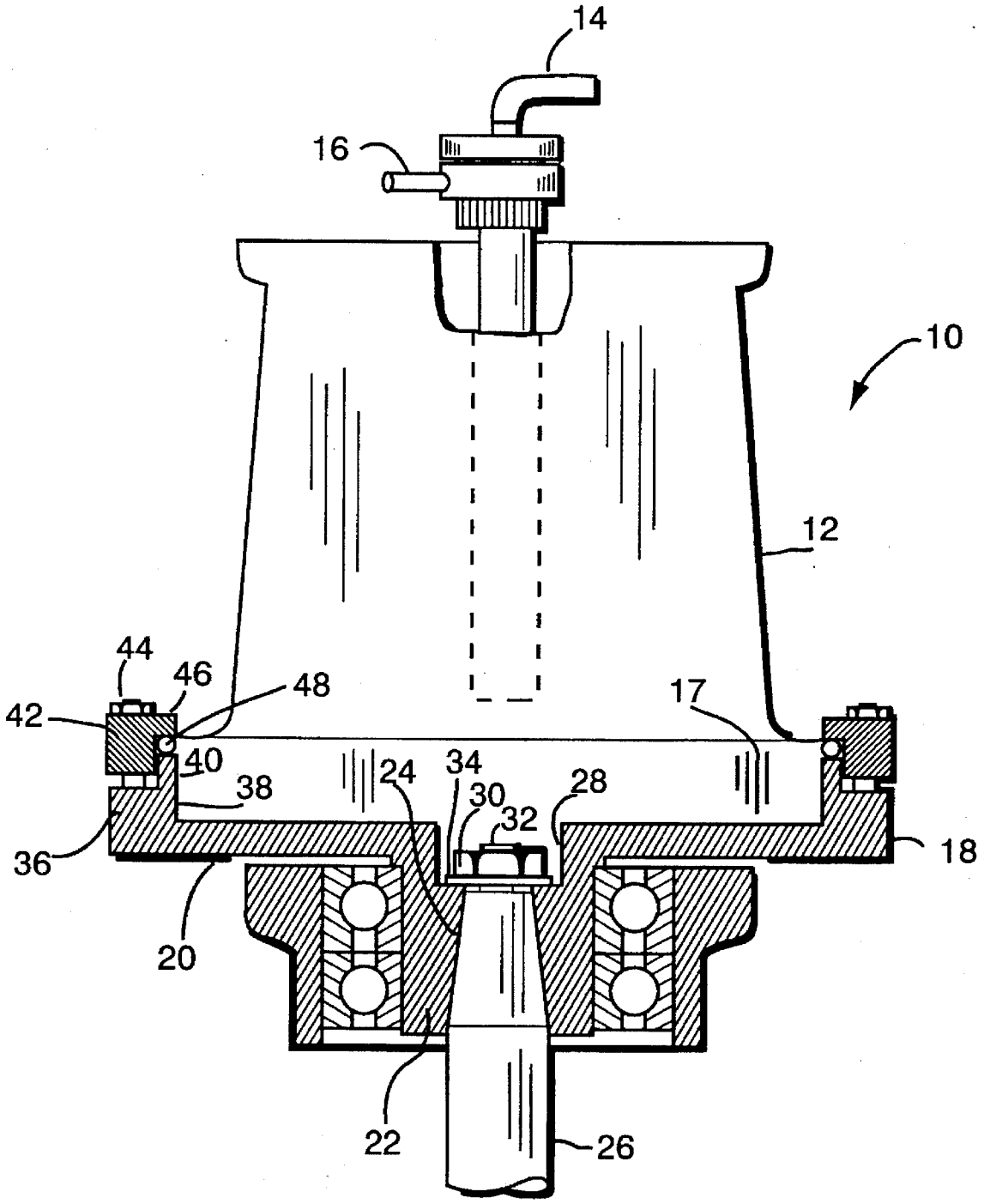
FIG. 1A (PRIOR ART)
FIG. 1A is an elevational view in cross-section of a conventional separating centrifuge.

FIG. 1A shows a conventional centrifuge 10 for separating the various components of whole blood. The centrifuge 10 includes a bowl 12 into which whole blood is introduced for separation. Whole blood is fed into the bowl 12 by way of an inlet port 14. Separated blood components are extracted from the bowl 12 through an outlet port 16.

A bottom portion 17 of the bowl 12 is mounted in a prior art chuck 18. The chuck 18 comprises a chuck body 20, having a hub 22 with a conical central bore 24. The central bore 24 is adapted to receive a spindle 26. The spindle 26 is attached to a motor (not shown) for rotating the chuck 18. A central recess 28 in the upper surface of the hub 22 is adapted to receive a spindle nut 30. To secure the chuck 18 to the spindle 26, the spindle nut 30 is threaded to a spindle stud 32 and tightened against a spindle washer 34.

Located around the outer circumference of the chuck body 20 is a cylindrical flange 36 extending upwardly toward the bowl 12, having an inner surface 38 for receiving the bottom portion 17 of the bowl 12. The flange 36 further includes an inner flange 40 also extending upwardly toward the bowl 12. An annular-shaped, chuck clamp ring 42 is mounted above the flange 36 by way of ring nuts 44. The chuck clamp ring 42 includes an inwardly extending portion 46 overlying the top face of inner flange 40. Disposed between inner flange 40 and inwardly extending portion 46 is an O-ring 48.

By tightening ring nuts 44, the O-ring 48 is compressed, creating surface engagement between the O-ring 48 and the bottom portion 17 of the bowl 12. As a result, the rotational speed of the chuck 18 is imparted to the bowl 12, permitting separation of the blood or other fluid fed into the bowl 12. To remove the bowl 12 from the chuck 18, following the separation process, the ring nuts 44 must be loosened so that the O-ring 48 will back off from its engagement with the bottom portion 17 of the bowl 12. The chuck 18 is then ready to receive another bowl.

This arrangement is limiting for several reasons. First, in order to mount the bowl 12 onto the chuck 18, an operator (not shown) must tighten each ring nut 44, which requires the use of a socket wrench or similar tool. The ring nuts 44 also must be tightened equally so that the O-ring 48 makes positive contact with the entire circumference of the bowl 12. Following the separation process, the operator must then loosen the ring nuts 44 so that the bowl 12 will fit past the otherwise compressed O-ring 48. This procedure results in a considerable amount of time needed to change separation bowls. If the ring nuts 44 are not sufficiently tightened, the bowl 12 could come loose during operation of the centrifuge 10. In addition, the large centrifugal forces can push the O-ring 48 outwardly, thereby rendering the bowl 12 less secure in the chuck 18. Finally, repeated use tends to wear the O-ring 48, requiring frequent inspections and replacement.

Figure 1B:
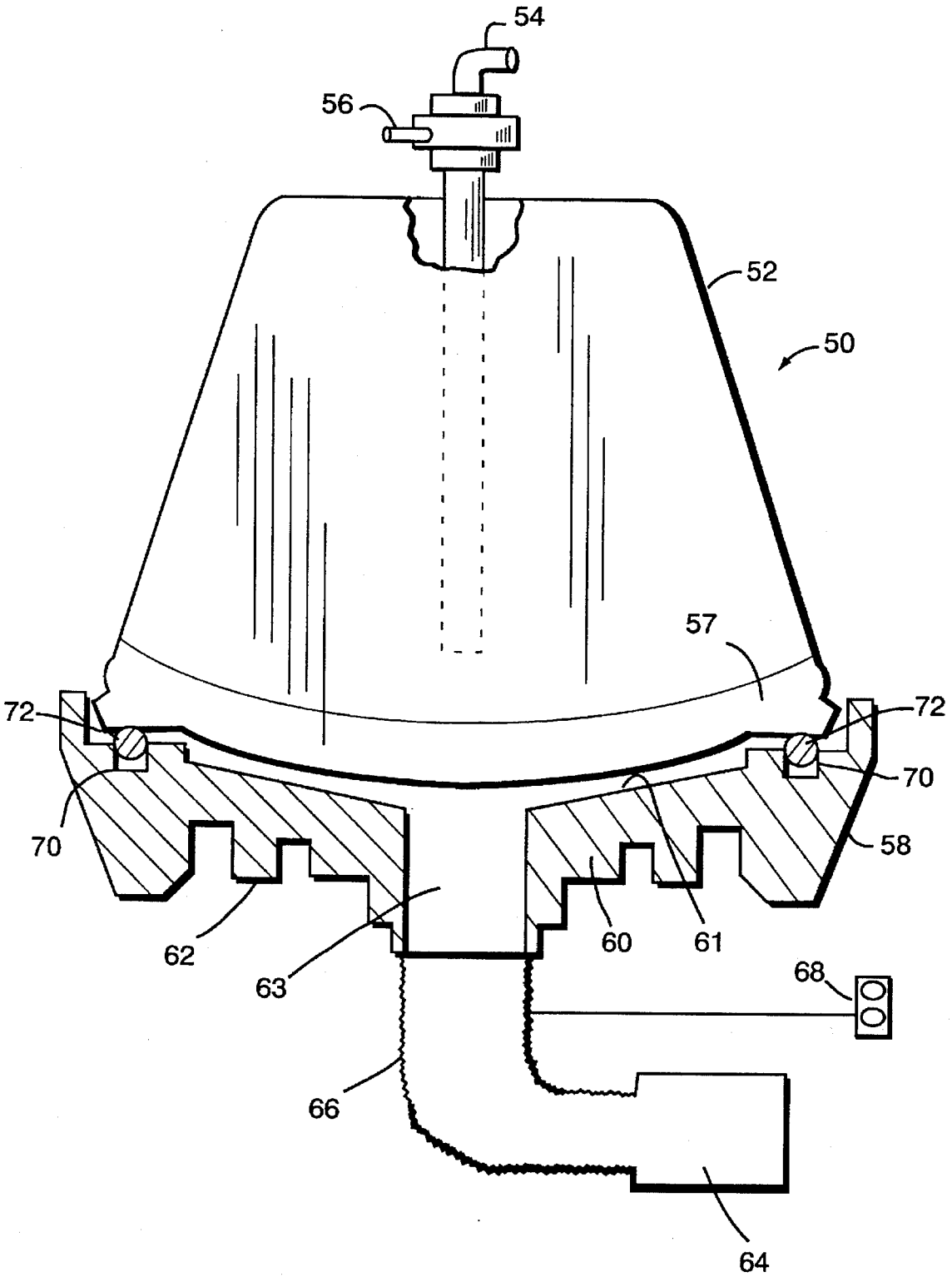
FIG. 1B (PRIOR ART)
FIG. 1B is an elevational view in cross-section of another conventional separating centrifuge.

FIG. 1B shows another conventional centrifuge 50 including a bowl 52 having an inlet port 54 for whole blood and an outlet port 56 for separated blood components. A base portion 57 of the bowl 52 is mounted in a conventional vacuum chuck 58. The vacuum chuck 58 comprises a chuck housing 60, having an upper surface 61 for receiving the base portion 57 of the bowl 52 and a lower surface 62 for receiving a centrifuge shaft (not shown). Extending centrally through the chuck housing 60 is a through hole 63. The through hole 63 is operably connected to a vacuum pump 64 by way of an air-tight duct 66. A release button 68 is connected to the air tight duct 66 for venting the duct 66 to atmospheric pressure.

An annular receiving channel 70 is formed in the upper surface 61 of the chuck housing 60. Disposed within the receiving channel 70 is a quad ring 72. When the bowl 52 is inserted into the vacuum chuck 58, the base portion 57 of the bowl 52 sits on the quad ring 72. During operation, the vacuum pump 64 creates a vacuum between the upper surface 61 of the chuck housing 60 and the base portion 57 of the bowl 52, which is sealed by the quad ring 72. The force of the vacuum secures the bowl 52 to the vacuum chuck 58 during the separation process. To remove the bowl 52 from the vacuum chuck 58, the vacuum must be released by pressing release button 68.

The vacuum chuck centrifuge 50 is also limiting for several reasons. First, the vacuum chuck centrifuge 50 includes a number of components, such as the vacuum pump 64, which are subject to wear and tear, requiring frequent maintenance of the system. In addition, the holding force exerted on the bowl 52 by the vacuum chuck 58 is limited to the amount of vacuum that can be drawn by the vacuum pump 64 and the surface area of the base portion 57. The downward pressure exerted on the base portion 57 of the bowl 52, during operation of the vacuum pump 64, also strains the welds used to attach the base portion 57 to the bowl 52. Finally, the release button 68 creates a possibility of damage to the bowl 52 or loss of blood product should the operator inadvertently release the vacuum before the vacuum chuck 58 stops spinning.

Figure 2:
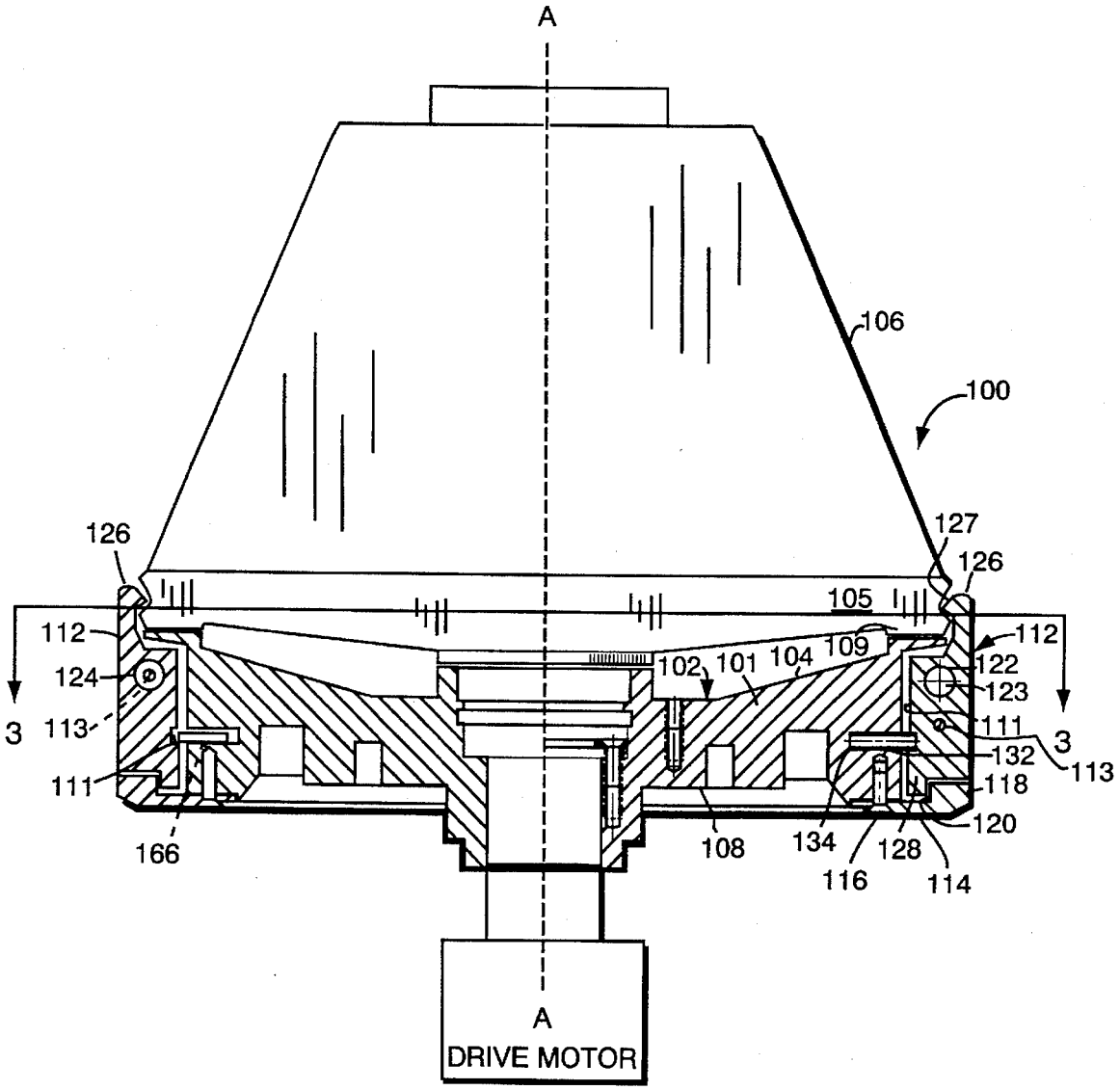
FIG. 2 is an elevational view in cross-section of the improved mechanical chuck according to the invention.
Figure 3:
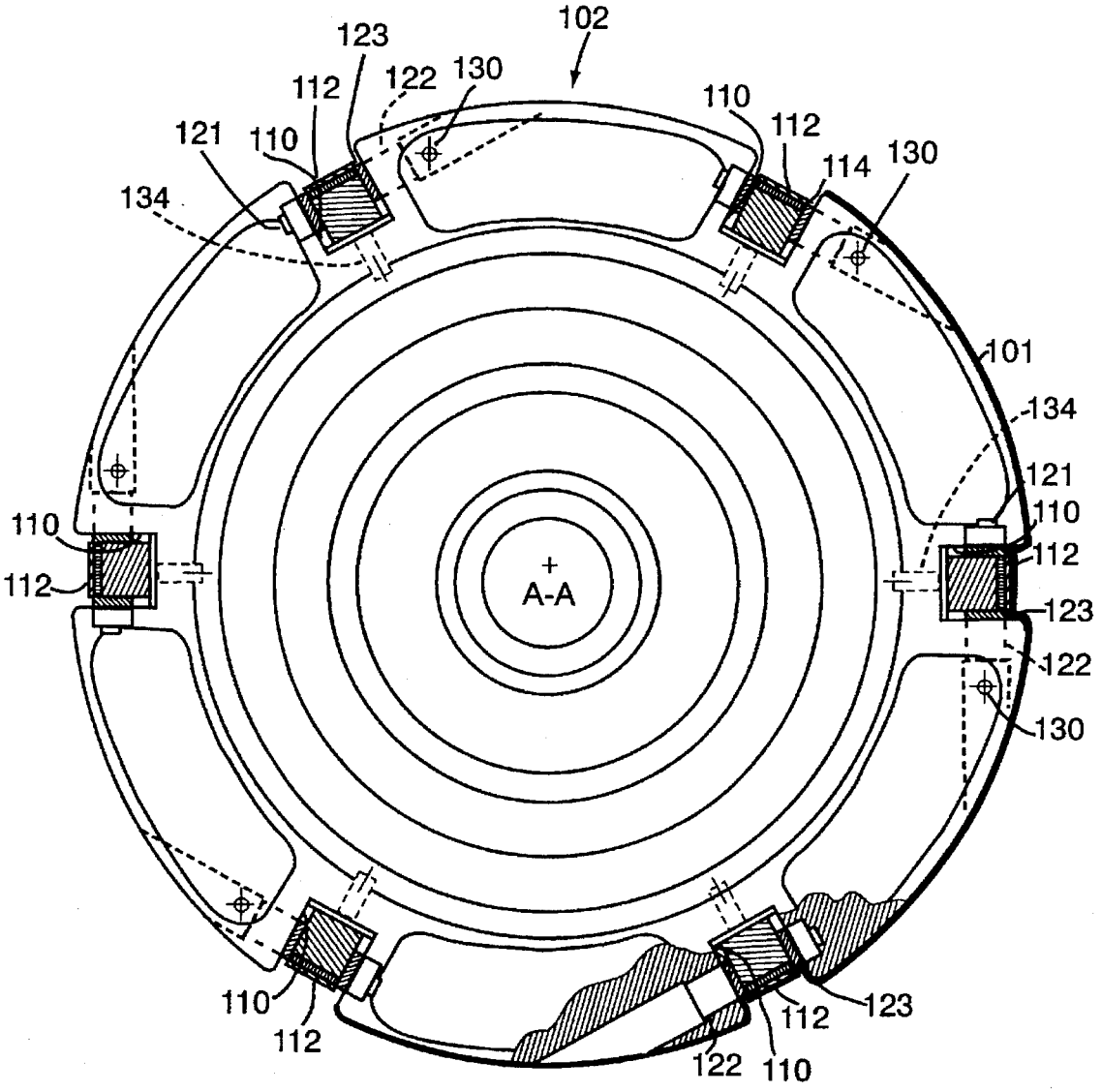
FIG. 3 is a plan view of FIG. 2 with the separation bowl removed.

As shown in FIGS. 2 and 3, the centrifuge 100 of applicant's invention comprises a chuck 102. The chuck 102 includes a chuck housing 101, having an upper surface 104 adapted to receive a lower portion 105 of a separation bowl 106 and a lower surface 108 adapted to receive a centrifuge shaft (not shown). Extending around the outer perimeter of the upper surface 104 of the chuck housing 101 is a support ledge 109. The centrifuge 100, moreover, has an axis of rotation along line A—A.

The chuck housing 101 has a plurality of slots 110 formed around its outer perimeter. The slots 110, which may be generally rectangular in shape, extend completely through the chuck housing 101 in an axial direction and also extend inwardly (toward the axis of rotation A—A) approximately one-eighth of the radius of the chuck housing 101. Each slot 110 is adapted to receive a single gripping finger 112. Accordingly, the number of slots 110 corresponds to the number of gripping fingers 112. Preferably, there are six slots 110 and six corresponding gripping fingers 112. As shown in FIG. 3, the six slots 110 and six gripping fingers 112 are equally spaced around the circumference of the chuck 102. It is understood, however, that the chuck 102 may have as few as three slots 110 and three gripping fingers 112 or as many slots 110 and gripping fingers 112 as the geometry of the chuck 102 will allow.

An annular-shaped, lower ring 114 is removably attached to the outer perimeter of the lower surface 108 of the chuck housing 101 by screws 116. It is understood that similar attaching means, such as a nut and bolt arrangement, may also be used to removably attach the lower ring 114 to the chuck housing 101. The lower ring 114 may also be formed as part of the chuck housing 101. The lower ring 114 may have an outer perimeter equal to the outer perimeter of the chuck housing 101, and a width equal to approximately one-quarter of the radius of the chuck housing 101. Preferably, the lower ring 114 will have a greater width than the slots 110, so that the ring 114 completely covers the lower portion of the slots 110. Lower ring 114 also includes an upper flange 118 that extends upwardly, toward the bowl 106, from the outer perimeter of the ring 114 and is located at a greater radial position than gripping finger 112. The upper flange 118 also includes an inner face 120, which faces inward toward the axis of rotation of the centrifuge 100.

The chuck housing 101 further includes a pin receiving slot 122, associated with each slot 110. As shown in FIG. 3, the pin receiving slots 122 are located in a plane perpendicular to the axis of rotation A—A and extend tangentially into the chuck housing 101 on either side of each slot 110. Preferably, the pin receiving slots 122 do not extend completely through the chuck housing 101, instead extending from the outer perimeter of the chuck housing 101 to an end point 121 within the chuck housing 101. It should be understood, however, that each pin receiving slot 122 may extend completely through the chuck housing 101.

Figure 6:
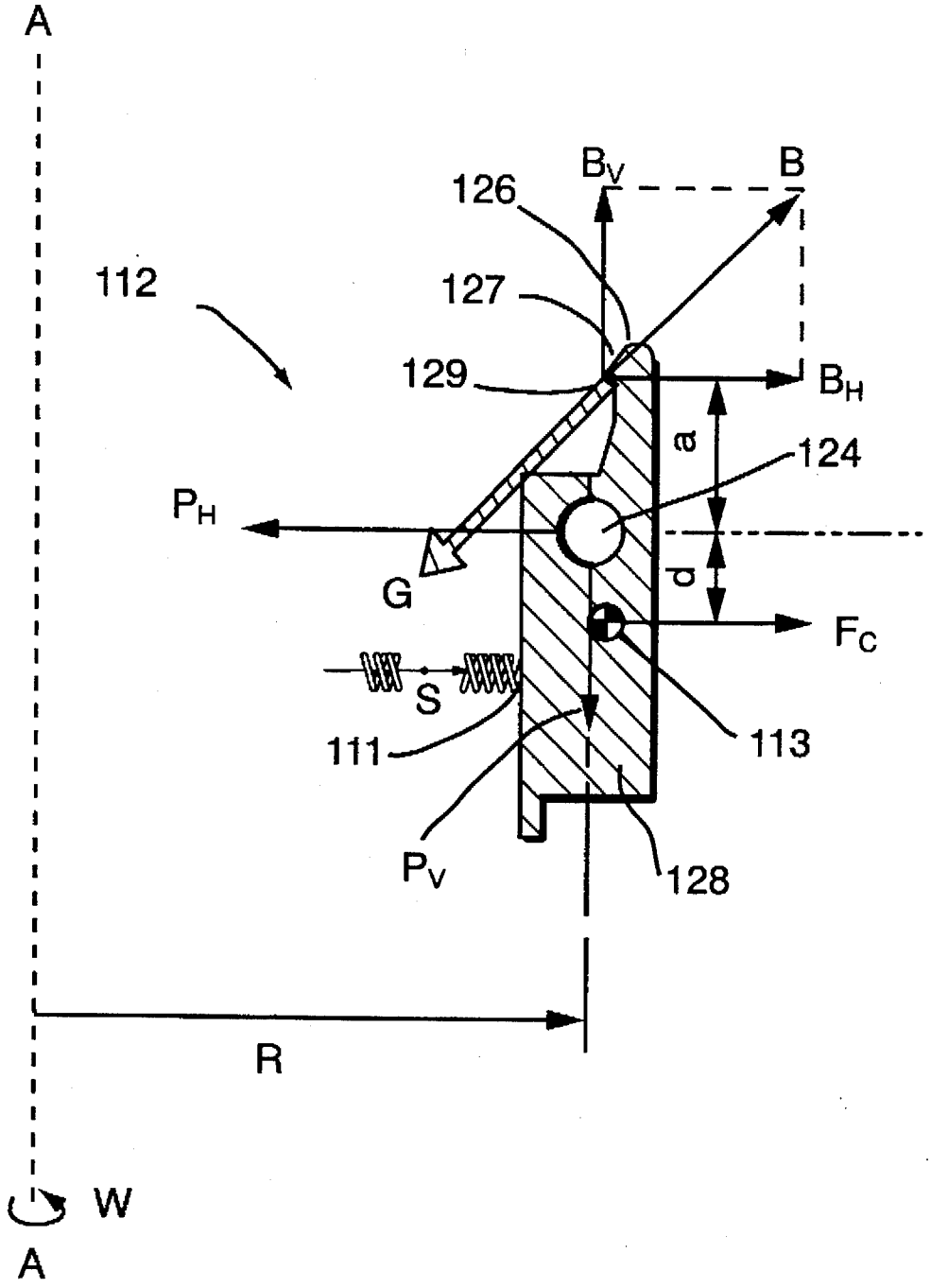
FIG. 6 is a side view of the gripping finger of the invention.

As shown in FIG. 2, each gripping finger 112 is pivotally mounted to the chuck housing 101. Each finger 112 may be mounted to the chuck housing 101 by means of a corresponding pin 123. As shown in FIG. 6, each finger 112 includes a pin hole 124 preferably located above the center of mass 113 of the gripping finger 112. The pin hole 124 is sized to receive the pin 123. Each gripping finger 112 also includes a tip portion 126 and a base portion 128. The tip portion 126 of each gripping finger 112 has an inner face 127.

The gripping finger 112 may be attached to the chuck housing 101 by placing the gripping finger 112 in the corresponding slot 110 with the tip portion 126 of the gripping finger 112 toward the upper surface 104 of the chuck housing 101 and the base portion 128 toward the lower surface 108 of the chuck housing 101. The pin hole 124 in each gripping finger 112 is then aligned with the corresponding pin receiving slot 122 in the chuck housing 101 and the pin 123 is inserted therein.

As shown in FIG. 3, to ensure that each pin 123 remains in the corresponding pin slot 122 during operation of the centrifuge 100, a stop screw 130 may be threadably attached to the chuck housing 101 at each pin receiving slot 122, following insertion of the pin 123. Each stop screw 130 passes perpendicularly through the corresponding pin receiving slot 122, thereby preventing the pin 123 from backing out of the pin slot 122. The stop screw 130 is proximate to the end of the pin 123, so that there is little or no movement of the pin 123 along the pin slot 122.

Rather than using a separate pin 123, it should be understood that each gripping finger 112 may be pivotally mounted to the chuck housing 101 by means of a pivotal boss (not shown) attached to and extending outwardly from either side of the finger 112 and into the pin slot 122.

As shown in FIG. 2, a spring 132 is preferably associated with each gripping finger 112. Each spring 132 is disposed between the chuck housing 101 and the corresponding finger 112. Each spring 132 contacts an inner face 111 of the corresponding gripping finger 112 below the pin 123. Each spring 132 may extend radially inward from the inner face 111 of the corresponding gripping finger 112 into a spring slot 134 formed in the chuck housing 101.

Figure 5C:
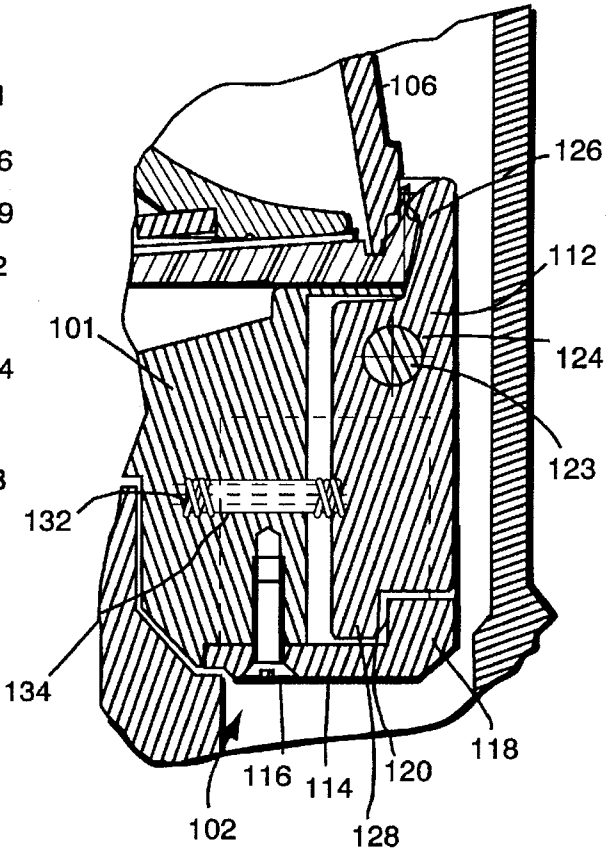
FIG. 5C is a partial cross-sectional view of the improved mechanical chuck according to the invention with the separation bowl fully seated in the improved mechanical chuck according to the invention.
Figure 5B:
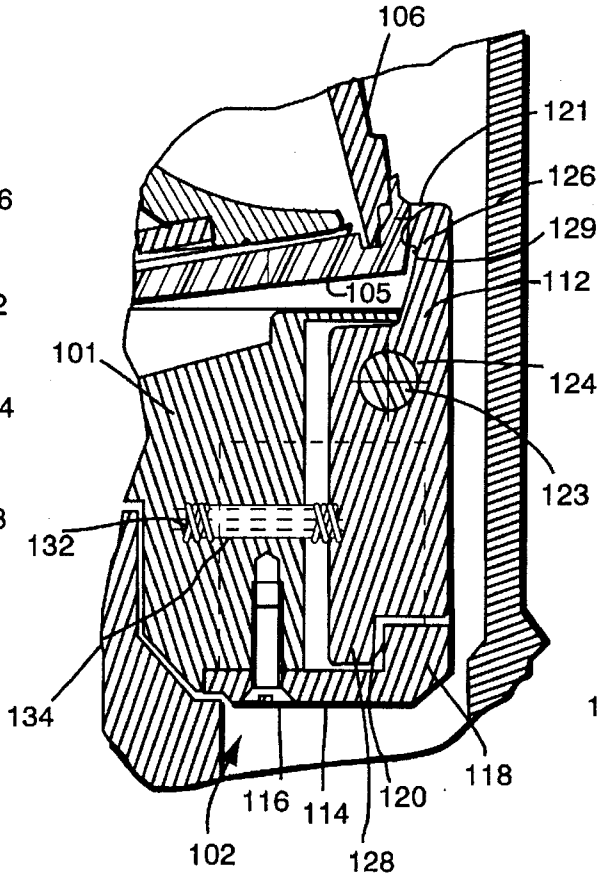
FIG. 5B is a partial cross-sectional view of the improved mechanical chuck according to the invention with the separation bowl being inserted.
Figure 5A:
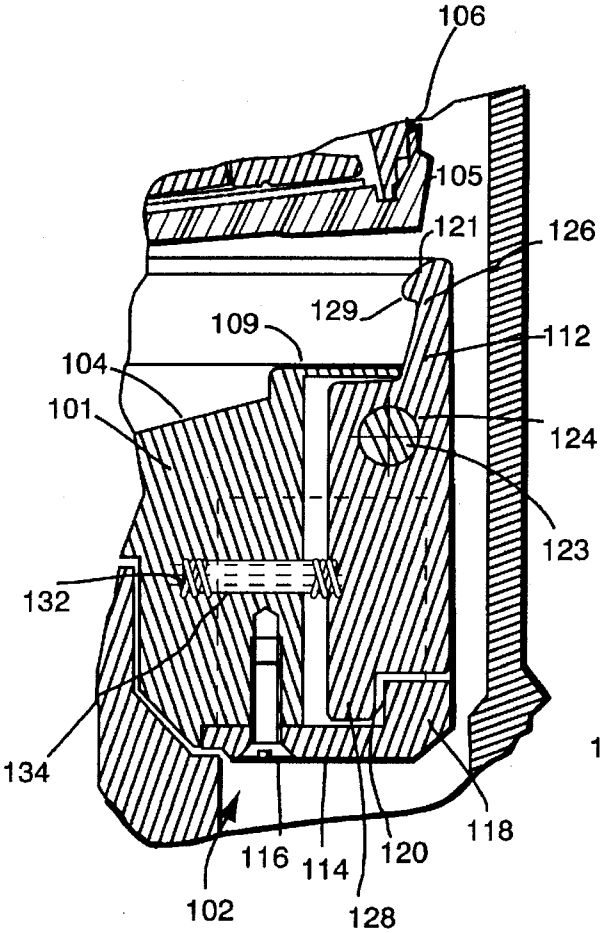
FIG. 5A is a partial cross-sectional view of the improved mechanical chuck according to the invention with the separation bowl removed.

Each spring 132 is biased to provide a slight outward force on the corresponding gripping finger 112. Since each spring 132 contacts the corresponding gripping finger 112 below the pin 123, i.e. closer to the lower surface 108 of the chuck housing 101, the spring 132 urges the gripping finger 112 to rotate about the pin 123, thereby forcing the tip 126 of the finger 112 inwardly toward the axis of rotation A—A. Rotation of the gripping finger 112 about pin 123, caused by the spring 132, ceases when the base portion 128 of the gripping finger 112 contacts the inner face 120 of lower ring 114, which acts as a stop. As shown in FIG. 5A, the inner face 120 is preferably positioned so that the tip 126 of the gripping finger 112 is angled slightly inward, toward the axis of rotation A—A, when the bowl 106 is removed from the centrifuge 100.

Figure 8:
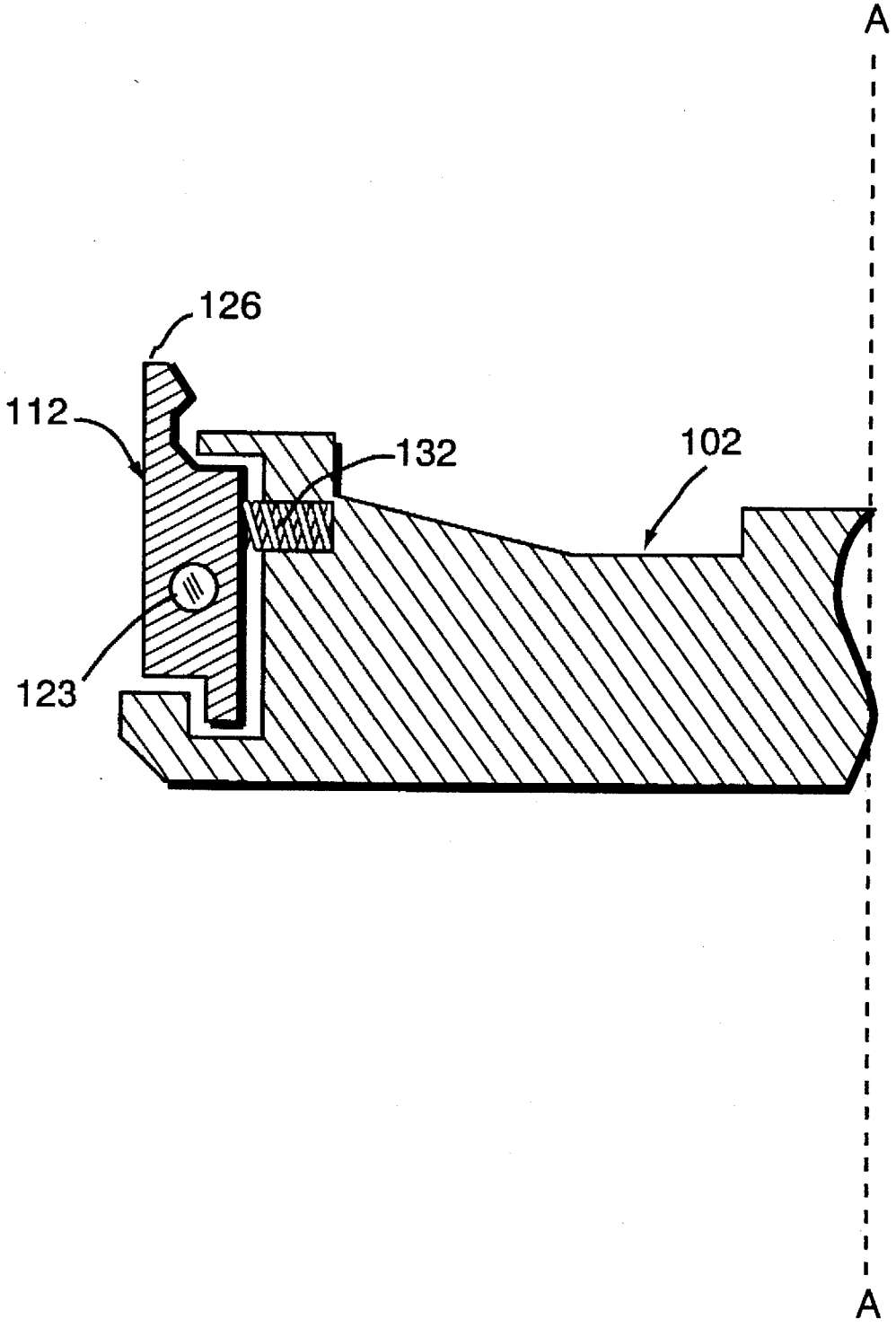
FIG. 8 is a partial cross-sectional view of another embodiment of the improved mechanical chuck according to the invention.

It should be understood that each spring 132 may instead be disposed between the chuck housing 101 and the corresponding gripping finger 112 above the pin 123 as shown in FIG. 8. The spring 132 would then be biased to urge the tip 126 of the gripping finger 126 toward the axis of rotation of the centrifuge 100. It should be further understood that the improved centrifugal chuck 102 may not include springs.

Figure 4:
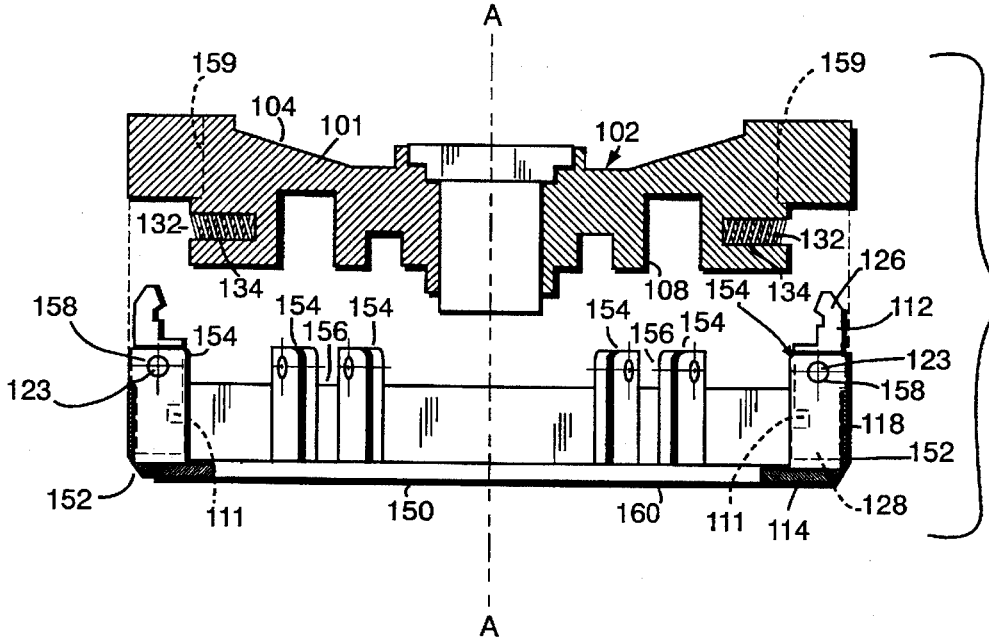
FIG. 4 is an elevational view in cross-section of another embodiment of the improved mechanical chuck according to the invention.

FIG. 4 shows another embodiment of the improved centrifugal chuck according to the invention, which includes a yoke housing 150 having an outer perimeter 152. Pairs of yokes 154, each associated with each gripping finger 112, are disposed around the outer perimeter 152 of the yoke housing 150. The yokes 154 extend in a generally axial direction parallel to the axis of rotation, A—A, of the chuck 102. Each pair of yokes 154 defines a receiving space 156 therebetween. Each receiving space 156 is adapted to receive the corresponding gripping finger 112 associated with the pair of yokes 154 so that the yokes 154 bracket the corresponding gripping finger 112. Extending colinearly through each pair of yokes 154 is a pin slot 158. Each pin slot 158 is preferably tangential to the outer perimeter 152 of the yoke housing 150.

Each gripping finger 112 is pivotally mounted within the corresponding pair of yokes 154, by inserting each gripping finger 112 into the corresponding receiving space 156. The pin hole 124 of each gripping finger 112 is then aligned with the pin slot 158 of the corresponding yokes 154 and the pin 123 is inserted therein. The finger 112 thus may pivot within the receiving space 156 about the pin 123.

The chuck housing 101 includes a plurality of yoke slots 159 disposed about the outer perimeter of the chuck housing 101. Each yoke slot 159 is adapted to receive a corresponding pair of yokes 154. The yoke housing 150 is inserted within the chuck housing 101 so that each pair of yokes 154 is received within the corresponding yoke slot 159 in the chuck housing 101. The yoke housing 150 is secured to the chuck housing 101 by suitable fastening means, such as a set of screws or a nut and bolt arrangement (not shown). The yoke slots 159 provide a close tolerance with the corresponding pair of yokes 154 so that each pin 123 is retained within pin slot 158 during operation of the chuck 102.

In this embodiment, the lower ring 114 is formed from the yoke housing 150. The lower ring 114 also may be removably attached to a lower surface 160 of the yoke housing 150, by screws or other similar fasteners.

As shown in FIG. 5A, when the bowl 106 is removed from the chuck 102, the tip 126 of each gripping finger 112 is biased slightly inward due to the force from the spring 132. As shown in FIG. 5B, when the bowl 106 is being inserted into the chuck 102, the lower portion 105 of the bowl 106 forces the tip 126 of each gripping finger 112 outwardly to permit insertion of the bowl 106. The inner face 127 of the tip 126, moreover, may be sloped to provide easier insertion of the bowl 106 into the chuck 102. A second inner face 129 of the tip 126 may be shaped to permit a "snap-fit" of the lower portion 105 of the bowl 106 when the bowl 106 is fully seated in the chuck 102. As shown in FIG. 5C, when the bowl 106 is fully seated in the chuck 102, the lower portion 105 rests on the support ledge 109 of the chuck housing 101 and contacts the gripping finger 112 only at the second inner face 129 of the tip 126. As will be explained in greater detail below, the second inner face 129 of the tip 126 is preferably sloped 45 degrees relative to the axis of rotation A—A, when the bowl 106 is fully seated in the chuck 102.

The gripping fingers 112 and the pins 123 are preferably formed from stainless steel and the chuck 102 is preferably formed from aluminum. It should be understood, however, that the gripping fingers 112, the pins 123 or the chuck 102 may be formed from other similar materials.

Referring now to FIG. 6, which illustrates the forces acting on the gripping finger 112 during centrifuge operation, a centrifugal force, $F_c$, arises when the centrifuge 100 begins to spin about axis A—A. The centrifugal force, $F_c$, acts on each gripping finger 112 perpendicular to the axis of rotation A—A and in an outward direction. The centrifugal force equation is $$F_c=m\omega^2R$$

where m is the mass of the finger 112, ω is the rotational velocity of the centrifuge 100 (in radians per second) and R is the radial distance of the finger 112 from the axis of rotation A—A. Although the centrifugal force acts over the entire finger 112, it can be presumed to act at the finger's center of mass 113 for purposes of determining the forces acting on the finger 112. Since the center of mass 113 of each gripping finger 112 is off-set from the pin 123 (the finger's pivot point) the centrifugal force, $F_c$, tries to rotate the gripping finger 112 about the pin 123. The bowl 106, however, prevents the finger 112 from rotating by applying a bowl force, B, to the gripping finger 112 at the second inner face 129 (the point of contact between the bowl 106 and the gripping finger 112). The bowl force, B, may be broken down into vertical and horizontal components, $B_v$ and $B_H$, respectively. Since the second inner face 129 is at a 45 degree angle from the centrifuge's axis of rotation A—A, the two components of the bowl force, $B_v$ and $B_H$, are equal. Finally, the spring 123 also imposes a generally horizontal force, S, on the gripping finger 112 at the inner face 111.

During operation of the centrifuge 100, the three horizontal forces acting outwardly on the gripping finger 112, namely $F_c$, $B_H$ and S, are opposed by a pin force, $P_H$, acting on each finger 112 through the pin 123. Similarly, the vertical component of the bowl force, $B_v$, is opposed by a force, $P_v$, acting on each finger 112 through the pin 123.

The bowl force, B, acting on each finger 112, is opposed by an equal and opposite gripping force, G, from the finger 112, acting, not on the finger 112, but on the bowl 106 at the second inner face 129. The gripping force, G, applied by each finger 112 to the bowl 106, has both an inward and a downward component (not shown) which are equal and opposite to the horizontal and vertical components, $B_H$ and $B_v$, of the bowl force, B. The magnitude of the gripping force, G, moreover, is directly proportional to the centrifugal force, $F_c$, acting on the gripping finger 112, because the sum of the moments acting on the stationary gripping finger 112, about the pin 123, must be zero. Specifically, the clockwise moment imposed by force $B_H$ ($B_H$ times distance a) must equal the counterclockwise moment imposed by the centrifugal force, $F_c$, ($F_c$ times distance d), assuming that the moments caused by the spring force, S, and force $B_v$ are negligible. In other words, $B_H \times a = F_c \times d$. Thus, the centrifugal force is directly proportional to the bowl force (and hence the corresponding gripping force on the bowl) depending on their respective distances from the pin 123.

Essentially, the centrifugal force, $F_c$, acting on each finger 112, is transmitted through the tip 126 of each finger 112, at the second inner face 129, to provide a gripping force, G, having both inward and downward components, on the bowl 106. As the rotational speed of the centrifuge 100 increases, moreover, the centrifugal force, $F_c$, on the finger 112 also increases. As shown above, this centrifugal force $F_c$, is transmitted into a gripping force, G, holding the bowl 106 in place in the chuck 102. As a result, the greater the rotational speed of the centrifuge 100, the greater the gripping force, G, exerted on the bowl 106 by each finger 112. This provides for an extremely safe attachment mechanism.

Referring again to FIG. 2, the center of mass 113 of the gripping finger 112 alternatively may be located at or near the pin hole 124. In this embodiment, shown on the left portion of the figure, a sliding mass 166 is disposed between each gripping finger 112 and the chuck housing 101 below the pivot point of the gripping finger 112. The sliding mass 166 is free to move in a radial direction and to contact the inner face 111 of the corresponding gripping finger 112. As the centrifuge 100 begins to spin, the centrifugal force causes each sliding mass 166 to move radially outward. When the sliding mass 166 contacts the inner face 111 of the corresponding gripping finger 112, it applies an outward force to the gripping finger 112, causing the tip 126 of the gripping finger 112 to pivot inwardly about the pin hole 124 and engage the lower portion 105 of the separation bowl 106. The outward force exerted by each sliding mass 166 on the corresponding gripping finger 112 is equal to the centrifugal force acting on the sliding mass 166.

Figure 7:
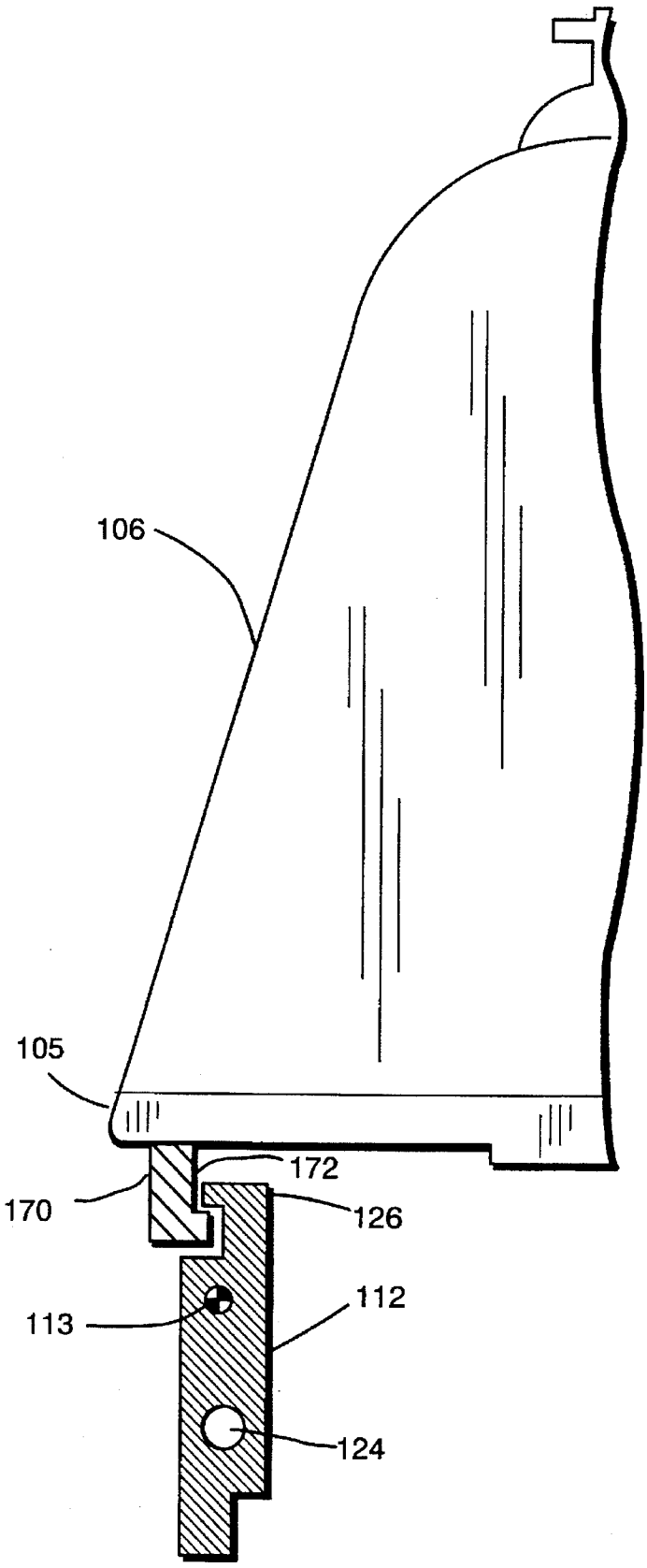
FIG. 7 is a partial elevational view in cross-section of another embodiment of the invention.

FIG. 7 shows another embodiment of the invention in which the center of mass 113 of each gripping finger 112 is located between the pin hole 124 and the tip 126 of the finger 112 so that the centrifugal force, acting on the finger 112, causes the tip 126 of the gripping finger 112 to pivot outwardly. In this embodiment, the separation bowl 106 includes a locking flange 170 extending downwardly from the outer perimeter of the lower portion 105 of the separation bowl 106. The tips 126 of the gripping fingers 112, moreover, are disposed inside of the locking flange 170 so that the tip 126 of each gripping finger 112, which rotates outwardly due to the centrifugal force, engages an inside surface 172 of the corresponding locking flange 170 thereby applying a gripping force to the separation bowl 106.

The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A centrifugal chuck for use in a centrifuge having a bowl and a centrifuge motor for rotating the centrifuge about an axis, the chuck comprising:

a chuck housing having an outer perimeter, an upper surface constructed to receive a base of the separation bowl and a lower surface constructed to receive the centrifuge motor;

at least three gripping fingers vertically disposed relative to the axis of rotation and pivotally mounted around the outer perimeter of the chuck housing, each gripping finger having a tip pivotal in a radial direction about a pivot point toward the bowl; and means for biasing each gripping finger, the biasing means engaging the gripping finger between the pivot point and the tip of the gripping finger and causing the tip of the gripping finger to pivot toward the axis of rotation of the centrifuge, wherein rotation of the chuck urges the tip of each gripping finger against the base of the bowl.

2. The centrifugal chuck of claim 1 wherein the biasing means comprises a spring radially disposed between each gripping finger and the chuck housing, each spring contacting the corresponding gripping finger between the pivot point and the tip of the gripping finger.

3. A centrifugal chuck for use in a centrifuge having a bowl and a centrifuge motor for rotating the centrifuge about an axis, the chuck comprising:

a chuck housing having an outer perimeter, an upper surface constructed to receive a base of the separation bowl and a lower surface constructed to receive the centrifuge motor;

at least three gripping fingers, each gripping finger having a tip and a pin receiving hole extending through the gripping finger;

a plurality of indentations spaced about the perimeter of the chuck housing, each indentation having two opposing side walls and constructed to receive a single gripping finger, each side wall including a collinear pin slot such that each gripping finger may be vertically positioned in the corresponding indentation relative to the axis of rotation with the pin receiving hole in the gripping finger aligned with the pin slot in the side walls and a pivot pin placed therein, thereby allowing the tip of each gripping finger to pivot in a radial direction toward the bowl; and restraining means for holding each pivot pin within the corresponding pin slot, wherein rotation of the chuck urges the tip of each gripping finger against the base of the bowl.

4. The centrifugal chuck of claim 3 wherein:

the restraining means comprises at least one stop screw, the stop screw extending across the pin slot in proximity to an end of the pivot pin so that the stop screw retains the corresponding pivot pin within the pin slot.

5. A centrifugal chuck for use in a centrifuge having a bowl and a centrifuge motor for rotating the centrifuge about an axis, the chuck comprising:

chuck housing having an outer perimeter, an upper surface constructed to receive a base of the separation bowl and a lower surface constructed to receive the centrifuge motor;

at least three gripping fingers, each gripping finger having a tip and a pin receiving hole extending through the gripping finger;

a pair of yokes for each gripping finger, the yokes disposed about the outer perimeter of the chuck housing and bracketing the corresponding gripping finger, a pin receiving slot extending collinearly through each pair of yokes such that the gripping finger may be vertically positioned between the pair of yokes relative to the axis of rotation with the pin receiving hole in the gripping finger aligned with the pin receiving slot in the yokes and a pivot pin placed therein, thereby allowing the tip of each gripping finger to pivot in a radial direction toward the bowl; and securing means for retaining each pivot pin within the pin receiving slot during operation of the centrifuge, wherein rotation of the chuck urges the tip of each gripping finger against the base of the bowl.

6. A centrifugal chuck for use in a centrifuge having a bowl and a centrifuge motor for rotating the centrifuge about an axis, the chuck comprising:

a chuck housing having an outer perimeter, an upper surface constructed to receive a base of the separation bowl and a lower surface constructed to receive the centrifuge motor;

a least three gripping fingers vertically disposed relative to the axis of rotation and pivotally mounted around the outer perimeter of the chuck housing, each gripping finger having a tip pivotal in a radial direction toward the bowl and a base portion; and a lower ring extending around the lower surface of the chuck housing at the outer perimeter, the lower ring having a flange extending toward the upper surface of the chuck housing and surrounding the base portions of the gripping fingers, wherein the flange has an inner face for stopping engagement with the base portion of each gripping finger, such that the inner face provides a stop to pivotal movement of the corresponding gripping finger when the base portion of the gripping finger pivots away from the axis of rotation of the centrifuge, and further wherein rotation of the chuck urges the tip of each gripping finger against the base of the bowl.

7. A centrifugal chuck for use in a centrifuge having a bowl and a centrifuge motor for rotating the centrifuge about an axis, the chuck comprising:

a chuck housing having an outer perimeter, an upper surface constructed to receive a base of the separation bowl and a lower surface constructed to receive the centrifuge motor;

at least three gripping fingers, each gripping finger having a tip, a base portion and a pin receiving hole extending through the gripping finger;

a pair of yokes for each gripping finger, the yokes disposed about the outer perimeter of the chuck housing and bracketing the corresponding gripping finger, a pin receiving slot extending collinearly through each pair of yokes such that the gripping finger may be vertically positioned between the pair of yokes relative to the axis of rotation with the pin receiving hole in the gripping finger aligned with the pin receiving slot in the yokes and a pivot pin placed therein, thereby allowing the tip of each gripping finger to pivot in a radial direction toward the bowl; and a lower ring extending around the lower surface of the chuck housing at the outer perimeter, the lower ring having a flange extending toward the upper surface of the chuck housing and surrounding the base portions of the gripping fingers, wherein the flange has an inner face for stopping engagement with the base portion of each gripping finger, such that the inner face provides a stop to pivotal movement of the corresponding gripping finger when the base portion of the gripping finger pivots away from the axis of rotation of the centrifuge, and further wherein rotation of the chuck urges the tip of each gripping finger against the base at the end of the bowl.

8. A centrifugal chuck for use in a centrifuge having a bowl and a centrifuge motor for rotating the centrifuge about an axis, the chuck comprising:

a chuck housing having an outer perimeter, an upper surface constructed to receive a base of the separation bowl and a lower surface constructed to receive the centrifuge motor;

at least three gripping fingers, each gripping finger having a tip and two opposing pivot studs extending outwardly from the gripping finger to form a pivotal boss;

a pair of yokes for each gripping finger, the yokes disposed about the outer perimeter of the chuck housing and bracketing the corresponding gripping finger; and a pin receiving slot extending collinearly into each pair of yokes such that the gripping finger may be vertically positioned between the pair of yokes relative to the axis of rotation with the pivot studs being received in the pin receiving slot in the yokes, thereby allowing the tip of the gripping finger to pivot in a radial direction toward the bowl, wherein rotation of the chuck urges the tip of each gripping finger against the base of the bowl.

9. A centrifugal chuck for use in a centrifuge having a bowl and a centrifuge motor for rotating the centrifuge about an axis, the chuck comprising:

a chuck housing having an outer perimeter, an upper surface constructed to receive a base of the separation bowl and a lower surface constructed to receive the centrifuge motor;

at least three gripping fingers vertically disposed relative to the axis of rotation and pivotally mounted around the outer perimeter of the chuck housing, each gripping finger having a tip pivotal in a radial direction toward the bowl, a center of mass and a base portion; and a locking flange extending downwardly from the base of the separation bowl toward the chuck housing, wherein the center of mass of each gripping finger is disposed between the pivot point of the finger and tip so that a centrifugal force, when acting on the finger, urges the tip of the finger to pivot toward the locking flange, thereby providing a gripping force on the bowl.

10. A centrifugal chuck for use in a centrifuge having a bowl and a centrifuge motor for rotating the centrifuge about an axis, the chuck comprising:

a chuck housing having an outer perimeter, an upper surface constructed to receive a base of the separation bowl and a lower surface constructed to receive the centrifuge motor;

at least three gripping fingers vertically disposed relative to the axis of rotation and pivotally mounted around the outer perimeter of the chuck housing, each gripping finger having a tip pivotal in a radial direction toward the bowl, a center of mass and a base portion; and a slidable mass disposed between each gripping finger and the chuck housing and further wherein the center of mass of each gripping finger is located near the pivot point of the finger and each slidable mass is free to move in a radial direction and to engage the corresponding gripping finger at a point between the pivot point and the base portion so that a centrifugal force, when acting on the slidable mass, drives the slidable mass into engagement with the corresponding gripping finger and urges the tip of the finger to pivot toward the base of the separation bowl, thereby providing a gripping force on the bowl.

11. A centrifugal chuck for use in a centrifuge having a bowl and a centrifuge motor for rotating the centrifuge about an axis, the chuck comprising:

a chuck housing having an outer perimeter, an upper surface constructed to receive a base of the separation bowl and a lower surface constructed to receive the centrifuge motor;

at least three gripping fingers, each gripping finger having a tip and two opposing pivot studs extending outwardly from the gripping finger to form a pivotal boss; and a plurality of indentations spaced about the perimeter of the chuck housing, each indentation having two opposing side walls and constructed to receive one gripping finger, each side wall including a collinear pin slot such that each gripping finger may be vertically positioned in the corresponding indentation relative to the axis of rotation with the pivot studs being received in the pin slot in the side walls, thereby allowing the tip of the gripping finger to pivot in a radial direction toward the bowl, wherein rotation of the chuck urges the tip of each gripping finger against the base of the bowl.

* * * * *